US010580381B2

(12) United States Patent
Zhang et al.

(10) Patent No.: US 10,580,381 B2
(45) Date of Patent: Mar. 3, 2020

(54) DIGITAL VCOM COMPENSATION FOR REDUCING DISPLAY ARTIFACTS

(71) Applicant: Apple Inc., Cupertino, CA (US)

(72) Inventors: Sheng Zhang, Milpitas, CA (US); Chaohao Wang, Sunnyvale, CA (US); Paolo Sacchetto, Cupertino, CA (US); Yunhui Hou, San Jose, CA (US)

(73) Assignee: Apple Inc., Cupertino, CA (US)

( * ) Notice: Subject to any disclaimer, the term of this patent is extended or adjusted under 35 U.S.C. 154(b) by 103 days.

(21) Appl. No.: 15/842,364

(22) Filed: Dec. 14, 2017

(65) Prior Publication Data

US 2018/0336863 A1 Nov. 22, 2018

Related U.S. Application Data

(60) Provisional application No. 62/507,604, filed on May 17, 2017.

(51) Int. Cl.
*G09G 3/36* (2006.01)

(52) U.S. Cl.
CPC ..... *G09G 3/3696* (2013.01); *G09G 3/3655* (2013.01); *G09G 2300/0426* (2013.01); *G09G 2320/02* (2013.01)

(58) Field of Classification Search
CPC ... G09G 3/3648; G09G 3/3655; G09G 3/3614
See application file for complete search history.

(56) References Cited

U.S. PATENT DOCUMENTS

2004/0169627 A1* 9/2004 Hong ..... G09G 3/3696 345/89
2007/0291190 A1* 12/2007 Shin ..... G09G 3/3696 349/37
2013/0082950 A1* 4/2013 Lim ..... G06F 3/0418 345/173
2013/0135279 A1* 5/2013 Pui ..... G09G 3/20 345/211
2015/0035818 A1* 2/2015 Shin ..... G09G 3/3648 345/212
2015/0194122 A1* 7/2015 Kim ..... G09G 3/3614 345/99
2015/0221248 A1* 8/2015 Kim ..... G09G 3/2044 345/204
2016/0140890 A1* 5/2016 Kim ..... G09G 3/3614 345/690

* cited by examiner

*Primary Examiner* — Nan-Ying Yang
(74) *Attorney, Agent, or Firm* — Fletcher Yoder P.C.

(57) ABSTRACT

The present disclosure relates to systems and methods of accounting for the kickback voltage in an LCD display. For example, a method may include obtaining, via a processor, a difference between a nominal voltage of a common electrode of a display and a measured voltage of the common electrode. The processor may obtain image data associated with an image to be displayed on the display. The processor may adjust the image data of a pixel of the display based on the difference. The processor may output an image signal indicative of the adjusted image data to a pixel electrode of the pixel.

20 Claims, 11 Drawing Sheets

208

210

212

| | | | | | |
|---|---|---|---|---|---|
| 8*8 | 8*16 | 8*32 | 8*32 | 8*16 | 8*8 |
| 16*8 | 16*16 | 16*32 | 16*32 | 16*16 | 16*8 |
| 32*8 | 32*16 | 32*32 | 32*32 | 32*16 | 32*8 |
| 32*8 | 32*16 | 32*32 | 214 32*32 | 32*16 | 32*8 |
| 32*8 | 32*16 | 32*32 | 32*32 | 32*16 | 32*8 |
| 16*8 | 16*16 | 16*32 | 16*32 | 16*16 | 16*8 |
| 8*8 | 8*16 | 8*32 | 8*32 | 8*16 | 8*8 |

NONUNIFORM COMPENSATION
GRID FOR ΔVCOM LOOK-UP

*FIG. 15*

DIGITAL VCOM COMPENSATION FOR REDUCING DISPLAY ARTIFACTS

CROSS-REFERENCE TO RELATED APPLICATION

This application claims priority to and benefit from U.S. Provisional Application No. 62/507,604, filed May 17, 2017, entitled "Digital VCOM Compensation for Reducing Display Artifacts," the contents of which is incorporated by reference in its entirety.

BACKGROUND

The present disclosure relates generally to electronic devices and, more particularly, to reducing display artifacts, such as flicker, in displays of the electronic devices.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Liquid crystal displays (LCDs) are commonly used as screens or displays for a wide variety of electronic devices, including consumer electronics such as televisions, computers, and handheld devices (e.g., cellular telephones, audio and video players, gaming systems, and so forth). Such devices typically provide a flat display in a relatively thin package that is suitable for use in a variety of electronic goods.

LCD panels include a backlight and an array of pixels. The pixels contain liquid crystal material that can modulate the amount of light that passes from the backlight through the pixels. By causing different pixels to emit different amounts of light, the pixels may collectively display images on the display. Modulating the amount of light that passes through each pixel involves controlling electric fields applied to the liquid crystal material of each pixel. In particular, each pixel may have a pixel electrode that stores a data voltage. Groups of pixels may share a common electrode that provides a common voltage (VCOM) voltage. The voltage difference between the data voltage on the pixel electrode and the common voltage on the common electrode creates an electric field in each pixel. The electric field causes the liquid crystal material to modulate the amount of light. Indeed, the liquid crystal molecules in the liquid crystal material rotate in a way that causes a particular amount of light to pass through the pixel; this rotation depends on the magnitude of the electric field. That is, what matters is the magnitude of the voltage difference—in fact, a positive voltage difference or a negative voltage difference of the same magnitude will generally cause the liquid crystal material to emit the same amount of light through the pixel. Thus, controlling the magnitude of the voltage difference between the pixel electrode and the common electrode controls the amount of light that passes through each pixel.

Yet the common voltage could differ from an expected voltage level under certain conditions. For example, the act of programming the pixels could cause a voltage known as a "kickback" voltage to change the common voltage from what would otherwise be expected. If the common voltage is different than expected, the voltage difference between the data voltage supplied to the pixel electrode and the common voltage on the common electrode could be different than expected. This could cause pixels to emit an incorrect amount of light and therefore produce a less desirable image. Moreover, to prevent long-term image artifacts, the polarity of the voltage difference may be selected to alternate from time to time, while keeping the same magnitude (e.g., if the common voltage is 0 V, and the desired magnitude of the voltage difference between the data voltage and the common voltage is 1 V, the data voltage may be supplied as 1 V at one time and −1 V at another time). But when the common voltage is different than expected, changing the polarity by changing the data voltage will produce different magnitudes of voltage differences at different times—and therefore cause different amounts of light to be emitted by the pixels at different times, even when the pixels should be emitting the same amount of light. When the magnitudes cause enough differences in the light to become visible to the human eye, this may appear as flickering artifacts on the display.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

The present disclosure relates to systems and methods of accounting for a kickback voltage on a common electrode of an LCD display by digitally adjusting the data signal before the data signal is applied to pixels of the display. Thus, a desired electric field between the common electrode and the pixel electrode of the pixel may be generated across the liquid crystal material of the LCD display, which may improve the quality of images produced on the LCD display. In particular, the data signal that will cause a charge to be stored on the pixel electrode may be digitally adjusted to account for a difference between the desired VCOM voltage and a measured VCOM voltage. This may cause the magnitude of the difference between the pixel electrode and the common electrode to result in the desired electric field across the liquid crystal material, and therefore to generate the desired amount of light at the pixel.

In some embodiments, a camera may be used to measure a difference between a desired common electrode voltage and a measured common electrode voltage. For example, images of the LCD display may be captured via a camera. The images may be processed to determine light emitted by pixels on the display. For instance, the light emitted by the pixels may be used to determine magnitudes of the VCOM voltage at different parts of the display. The magnitude of the VCOM voltage may be compared to a reference voltage to generate a nonuniform VCOM map of the LCD display. The display may use the nonuniform VCOM map and adjust the pixel electrode voltage to account for the nonuniform VCOM due to the kickback voltages.

In an embodiment, a display includes a common electrode, a unit pixel having a pixel electrode and a transistor that switches to store a voltage between the pixel electrode and the common electrode. The display includes a processor operatively coupled to a memory. The processor may obtain a difference between a desired common electrode voltage and a measured common electrode voltage. The processor may receive a desired voltage to be output to the pixel electrode. The processor may output a compensation signal having a voltage based on the difference.

BRIEF DESCRIPTION OF THE DRAWINGS

Various aspects of this disclosure may be better understood upon reading the following detailed description and upon reference to the drawings in which:

FIG. 15 is a schematic diagram of a grid of a lookup table that may be stored in the memory of the electronic device of FIG. 1, in accordance with an embodiment.

DETAILED DESCRIPTION OF SPECIFIC EMBODIMENTS

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Figure 1:
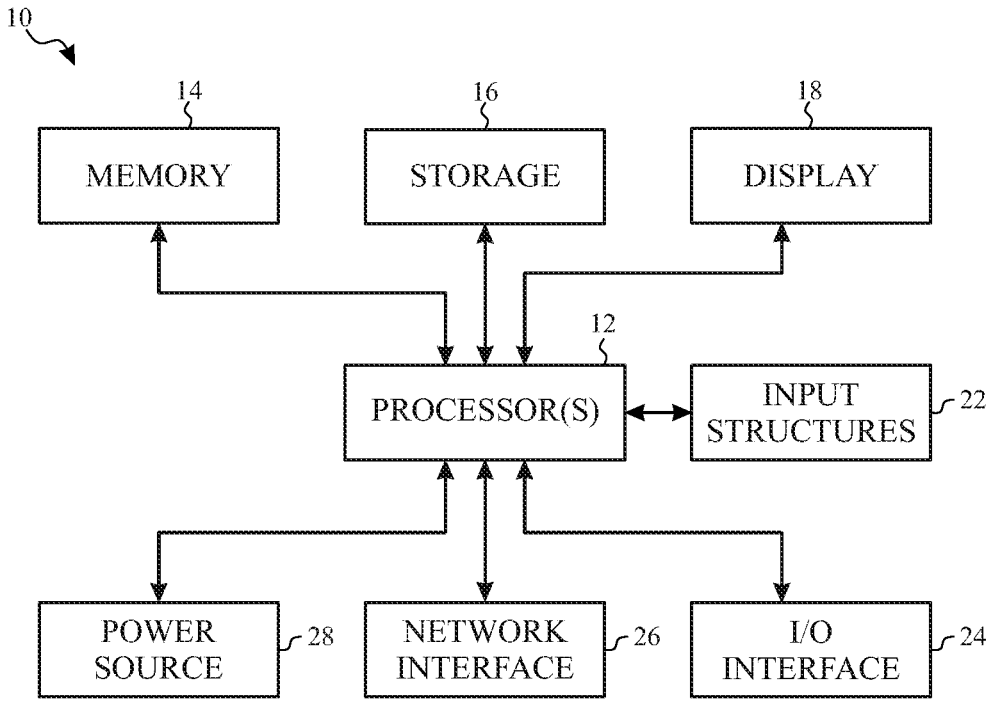
FIG. 1 is a schematic block diagram of an electronic device that may benefit from the inclusion of one or more matched capacitor devices, in accordance with an embodiment.

With these features in mind, a general description of suitable electronic devices that may account for nonuniformities in a VCOM voltage on a common electrode of the display. With the foregoing in mind, a general description of suitable electronic devices that may employ a device having matched capacitors in its circuitry will be provided below. With the foregoing in mind, a general description of suitable electronic devices that may employ a device having low-noise capacitor structures in its circuitry will be provided below. Turning first to FIG. 1, an electronic device 10 according to an embodiment of the present disclosure may include, among other things, one or more processor(s) 12, memory 14, nonvolatile storage 16, a display 18, input structures 22, an input/output (I/O) interface 24, a network interface 26, and a power source 28. The various functional blocks shown in FIG. 1 may include hardware elements (including circuitry), software elements (including computer code stored on a computer-readable medium) or a combination of both hardware and software elements. It should be noted that FIG. 1 is merely one example of a particular implementation and is intended to illustrate the types of components that may be present in electronic device 10.

Figure 2:
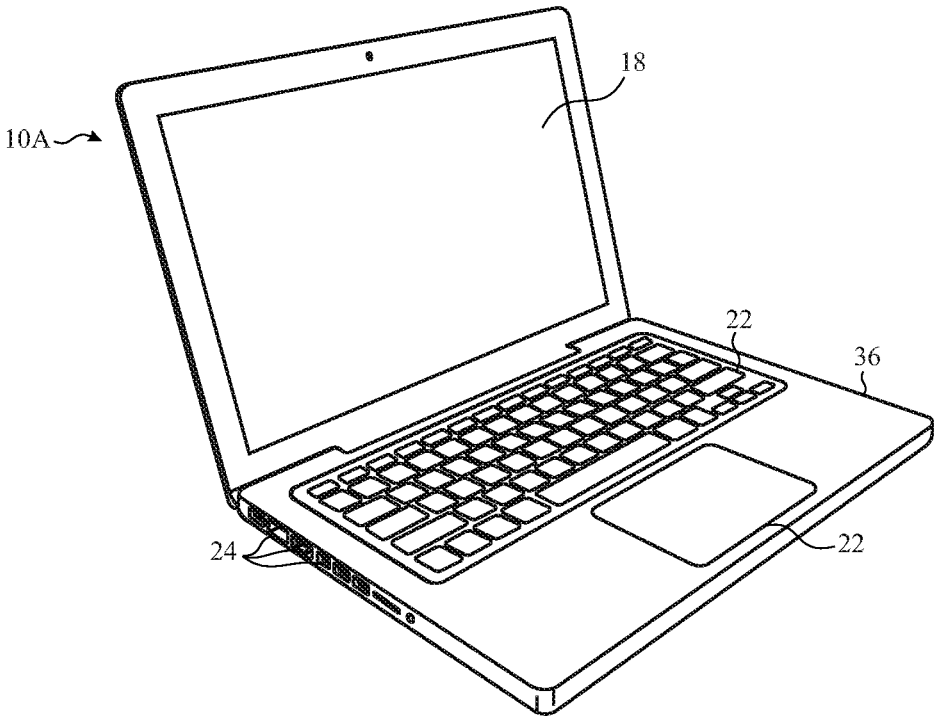
FIG. 2 is a perspective view of a notebook computer representing an embodiment of the electronic device of FIG. 1.
Figure 3:
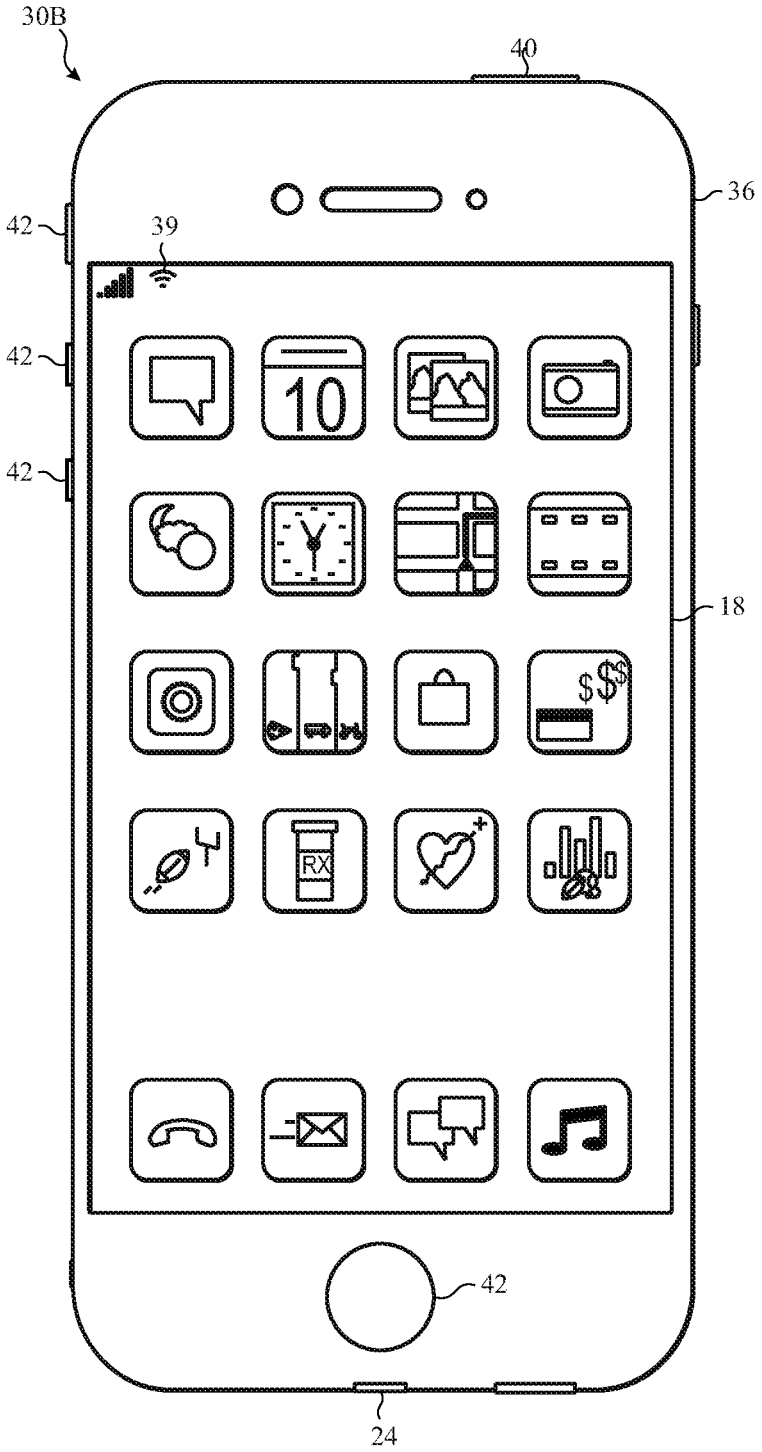
FIG. 3 is a front view of a hand-held device representing another embodiment of the electronic device of FIG. 1.
Figure 4:
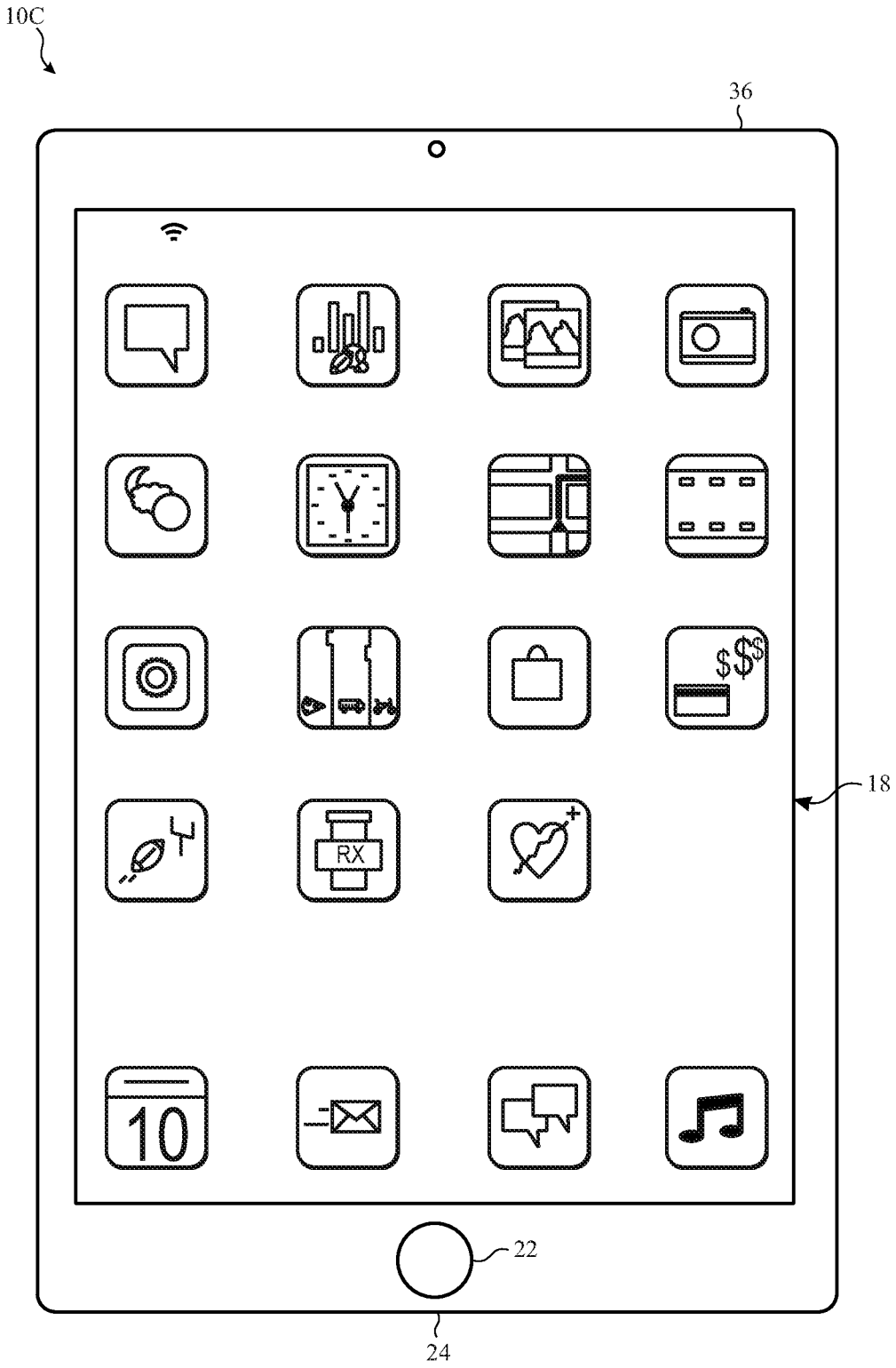
FIG. 4 is a front view of another hand-held device representing another embodiment of the electronic device of FIG. 1.
Figure 5:
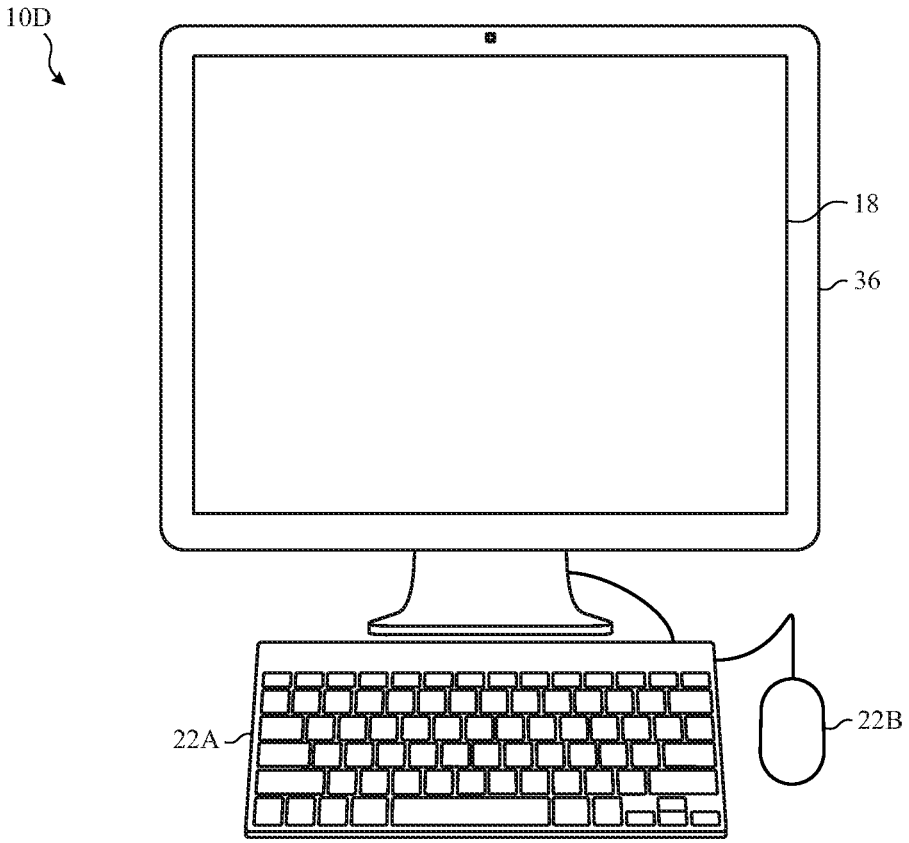
FIG. 5 is a front view of a desktop computer representing another embodiment of the electronic device of FIG. 1.
Figure 6:
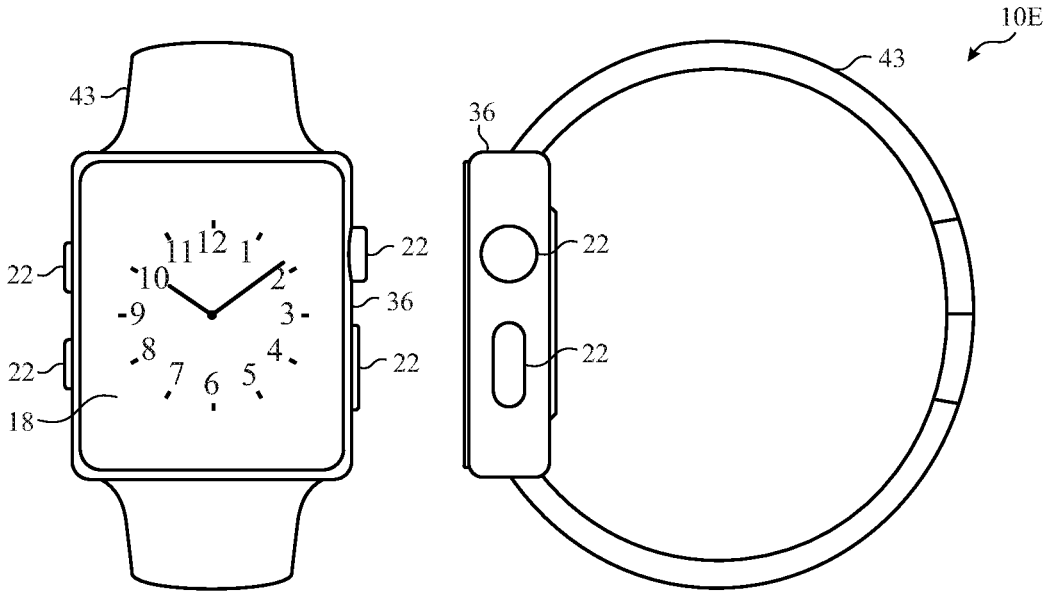
FIG. 6 is a front view and side view of a wearable electronic device representing another embodiment of the electronic device of FIG. 1.

By way of example, the electronic device 10 may represent a block diagram of the notebook computer depicted in FIG. 2, the handheld device depicted in FIG. 3, the handheld device depicted in FIG. 4, the desktop computer depicted in FIG. 5, the wearable electronic device depicted in FIG. 6, or similar devices. It should be noted that the processor(s) 12 and other related items in FIG. 1 may be generally referred to herein as "data processing circuitry." Such data processing circuitry may be embodied wholly or in part as software, firmware, hardware, or any combination thereof. Furthermore, the data processing circuitry may be a single contained processing module or may be incorporated wholly or partially within any of the other elements within the electronic device 10.

In the electronic device 10 of FIG. 1, the processor(s) 12 may be operably coupled with the memory 14 and the nonvolatile storage 16 to perform various algorithms. Such programs or instructions executed by the processor(s) 12 may be stored in any suitable article of manufacture that includes one or more tangible, computer-readable media at least collectively storing the instructions or routines, such as the memory 14 and the nonvolatile storage 16. The memory 14 and the nonvolatile storage 16 may include any suitable articles of manufacture for storing data and executable instructions, such as random-access memory, read-only memory, rewritable flash memory, hard drives, and optical discs. In addition, programs (e.g., an operating system) encoded on such a computer program product may also include instructions that may be executed by the processor(s) 12 to enable the electronic device 10 to provide various functionalities.

In certain embodiments, the display 18 may be a liquid crystal display (LCD), which may allow users to view images generated on the electronic device 10. In some embodiments, the display 18 may include a touch screen, which may allow users to interact with a user interface of the electronic device 10. Furthermore, it should be appreciated that, in some embodiments, the display 18 may include one or more organic light emitting diode (OLED) displays, or some combination of LCD panels and OLED panels.

The input structures 22 of the electronic device 10 may enable a user to interact with the electronic device 10 (e.g., pressing a button to increase or decrease a volume level). The I/O interface 24 may enable electronic device 10 to interface with various other electronic devices, as may the network interface 26. The network interface 26 may include, for example, one or more interfaces for a personal area network (PAN), such as a Bluetooth network, for a local area network (LAN) or wireless local area network (WLAN), such as an 802.11x Wi-Fi network, and/or for a wide area network (WAN), such as a 3rd generation (3G) cellular network, 4th generation (4G) cellular network, long term evolution (LTE) cellular network, or long term evolution license assisted access (LTE-LAA) cellular network. The network interface 26 may also include one or more interfaces for, for example, broadband fixed wireless access networks (WiMAX), mobile broadband Wireless networks (mobile WiMAX), asynchronous digital subscriber lines (e.g., ADSL, VDSL), digital video broadcasting-terrestrial (DVB-T) and its extension DVB Handheld (DVB-H), ultra-Wideband (UWB), alternating current (AC) power lines, and so forth. Network interfaces 26 such as the one described above may benefit from the use of tuning circuitry, impedance matching circuitry and/or noise filtering circuits that may include low-noise capacitor structures devices such as the ones described herein. As further illustrated, the electronic device 10 may include a power source 28. The power source 28 may include any suitable source of power, such as a rechargeable lithium polymer (Li-poly) battery and/or an alternating current (AC) power converter.

In certain embodiments, the electronic device 10 may take the form of a computer, a portable electronic device, a wearable electronic device, or other type of electronic device. Such computers may include computers that are generally portable (such as laptop, notebook, and tablet computers) as well as computers that are generally used in one place (such as conventional desktop computers, workstations, and/or servers). In certain embodiments, the electronic device 10 in the form of a computer may be a model of a MacBook®, MacBook® Pro, MacBook Air®, iMac®, Mac® mini, or Mac Pro® available from Apple Inc. By way of example, the electronic device 10, taking the form of a notebook computer 10A, is illustrated in FIG. 2 in accordance with one embodiment of the present disclosure. The depicted computer 10A may include a housing or enclosure 36, a display 18, input structures 22, and ports of an I/O interface 24. In one embodiment, the input structures 22 (such as a keyboard and/or touchpad) may be used to interact with the computer 10A, such as to start, control, or operate a GUI or applications running on computer 10A. For example, a keyboard and/or touchpad may allow a user to navigate a user interface or application interface displayed on display 18.

FIG. 3 depicts a front view of a handheld device 10B, which represents one embodiment of the electronic device 10. The handheld device 10B may represent, for example, a portable phone, a media player, a personal data organizer, a handheld game platform, or any combination of such devices. By way of example, the handheld device 10B may be a model of an iPod® or iPhone® available from Apple Inc. of Cupertino, Calif. The handheld device 10B may include an enclosure 36 to protect interior components from physical damage and to shield them from electromagnetic interference. The enclosure 36 may surround the display 18. The I/O interfaces 24 may open through the enclosure 36 and may include, for example, an I/O port for a hard wired connection for charging and/or content manipulation using a standard connector and protocol, such as the Lightning connector provided by Apple Inc., a universal service bus (USB), or other similar connector and protocol.

User input structures 22, in combination with the display 18, may allow a user to control the handheld device 10B. For example, the input structures 22 may activate or deactivate the handheld device 10B, navigate user interface to a home screen, a user-configurable application screen, and/or activate a voice-recognition feature of the handheld device 10B. Other input structures 22 may provide volume control, or may toggle between vibrate and ring modes. The input structures 22 may also include a microphone may obtain a user's voice for various voice-related features, and a speaker may enable audio playback and/or certain phone capabilities. The input structures 22 may also include a headphone input may provide a connection to external speakers and/or headphones.

FIG. 4 depicts a front view of another handheld device 10C, which represents another embodiment of the electronic device 10. The handheld device 10C may represent, for example, a tablet computer, or one of various portable computing devices. By way of example, the handheld device 10C may be a tablet-sized embodiment of the electronic device 10, which may be, for example, a model of an iPad® available from Apple Inc. of Cupertino, Calif.

Turning to FIG. 5, a computer 10D may represent another embodiment of the electronic device 10 of FIG. 1. The computer 10D may be any computer, such as a desktop computer, a server, or a notebook computer, but may also be a standalone media player or video gaming machine. By way of example, the computer 10D may be an iMac®, a MacBook®, or other similar device by Apple Inc. It should be noted that the computer 10D may also represent a personal computer (PC) by another manufacturer. A similar enclosure 36 may be provided to protect and enclose internal components of the computer 10D such as the display 18. In certain embodiments, a user of the computer 10D may interact with the computer 10D using various peripheral input devices, such as the keyboard 22A or mouse 22B (e.g., input structures 22), which may connect to the computer 10D.

Similarly, FIG. 6 depicts a wearable electronic device 10E representing another embodiment of the electronic device 10 of FIG. 1 that may be configured to operate using the techniques described herein. By way of example, the wearable electronic device 10E, which may include a wristband 43, may be an Apple Watch® by Apple, Inc. However, in other embodiments, the wearable electronic device 10E may include any wearable electronic device such as, for example, a wearable exercise monitoring device (e.g., pedometer, accelerometer, heart rate monitor), or other device by another manufacturer. The display 18 of the wearable electronic device 10E may include a touch screen display 18 (e.g., LCD, OLED display, active-matrix organic light emitting diode (AMOLED) display, and so forth), as well as input structures 22, which may allow users to interact with a user interface of the wearable electronic device 10E.

Figure 7:
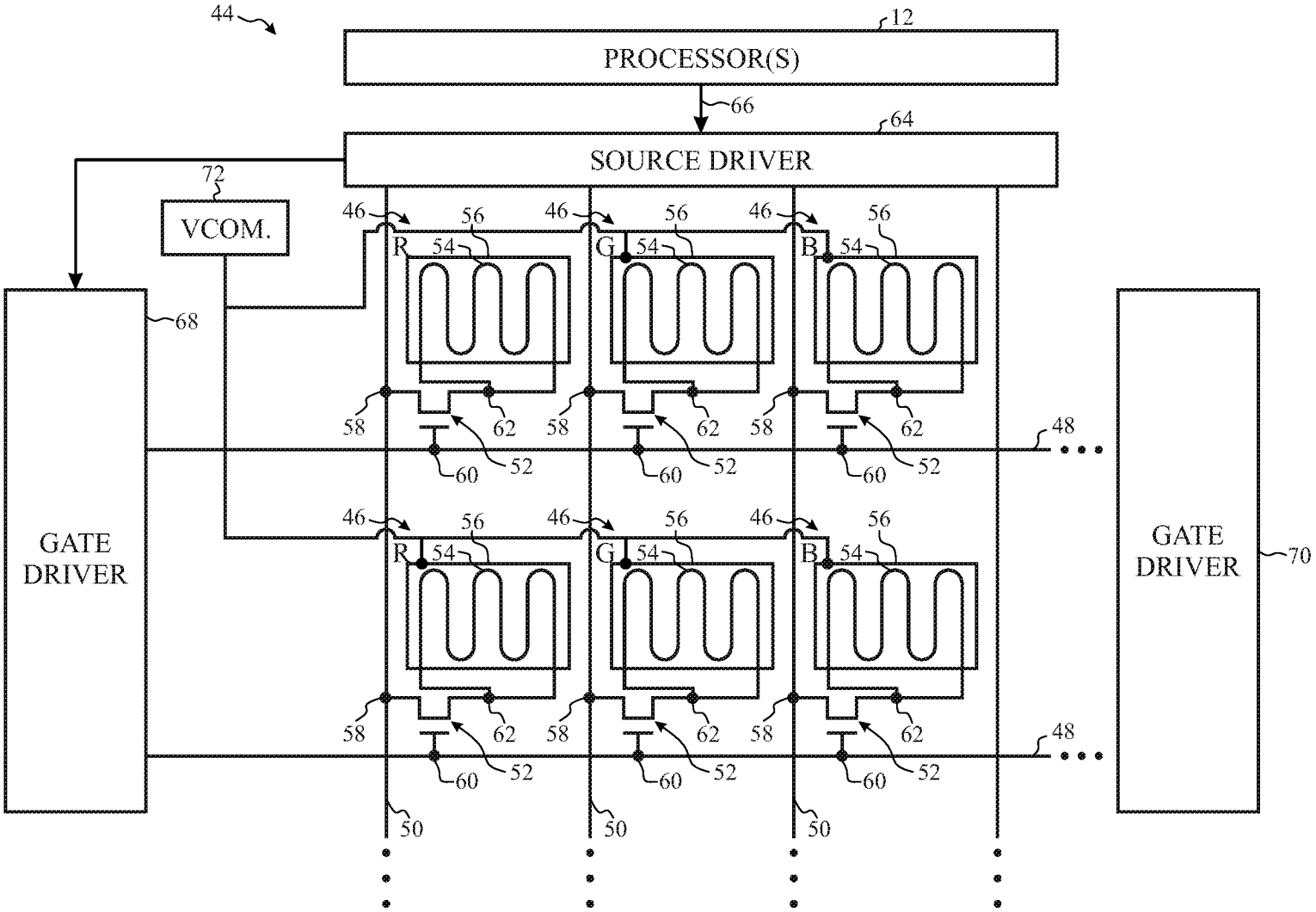
FIG. 7 is a schematic diagram of display components of an electronic display, in accordance with an embodiment.

Turning now to FIG. 7, which generally represents a circuit diagram of certain components of the display 18 in accordance with some embodiments. In particular, the pixel array 44 of the display 18 may include a number of unit pixels 46 disposed in a pixel array or matrix. In such an array, each unit pixel 46 may be defined by the intersection of rows and columns, represented by gate lines 48 (also referred to as scanning lines), and data lines 50, respectively. Although only 6 unit pixels 46 are shown for purposes of simplicity, it should be understood that in an actual implementation, each data line 50 and gate line 48 may include hundreds or thousands of such unit pixels 46. Each of the unit pixels 46 may represent one of three subpixels that respectively filters only one color (e.g., red, blue, or green) of light through, for example, a color filter. The terms "pixel," "subpixel," and "unit pixel" may be used largely interchangeably to refer to each individual picture element of the electronic display 18. However, the term "pixel" also sometimes refers to a collection of subpixels that can collectively display any suitable color (e.g., a pixel may be formed from a red subpixel, a green subpixel, and a blue subpixel; collectively, the pixel may be able to display any suitable color that can be formed by mixing red, green, and blue light).

As shown in FIG. 7, each unit pixel 46 may include a thin film transistor (TFT) 52 for switching a data signal stored on a respective pixel electrode 54. The potential stored on the pixel electrode 54 relative to a potential of a common electrode 56 (e.g., creating a liquid crystal capacitance $C_{ST}$), which may be shared by other pixels 46, may generate an electrical field sufficient to alter the arrangement of liquid crystal molecules of each unit pixel 46. In the illustrated embodiment of FIG. 7, a source 58 of each TFT 52 may be electrically connected to a data line 50 and a gate 60 of each TFT 52 may be electrically connected to a gate line 48. A drain 62 of each TFT 52 may be electrically connected to a respective pixel electrode 54. Each TFT 52 may serve as a switching element that may be activated and deactivated (e.g., turned "ON" and turned "OFF") for a predetermined period of time based on the respective presence or absence of a scanning signal on the gate lines 48 that are applied to the gates 60 of the TFTs 52.

When activated, a TFT 52 may store the image signals received via the respective data line 50 as a charge upon the corresponding pixel electrode 54. As noted above, the image signals stored by the pixel electrode 54 may be used to generate an electrical field between the respective pixel electrode 54 and a common electrode 56. This electrical field may align the liquid crystal molecules to modulate light transmission through the pixel 46. Furthermore, it should be appreciated that each unit pixel 46 may also include a storage capacitor, or circuitry that may be modeled as a capacitor, which may be used to sustain the pixel electrode voltage (e.g., $V_{pixel}$) during the time in which the TFTs 52 may be switch to the "OFF" state.

In certain embodiments, the display 18 also may include a source driver integrated circuit (IC) 64, which may include a chip, such as a processor or application specific integrated circuit (ASIC) that controls the display pixel array 44 by receiving image data 66 from the processor(s) 12, and sending corresponding image signals to the unit pixels 46 of the pixel array 44. The source driver 64 may also provide timing signals to the gate drivers 68 and 70 to facilitate the activation/deactivation of individual rows of pixels 46. In other embodiments, timing information may be provided to the gate drivers 68 and 70 in some other manner. The display 18 may include a common voltage (VCOM) source 72 to provide a common voltage (VCOM) voltage to the common electrodes 56 of each of the pixels 46.

Figure 8:
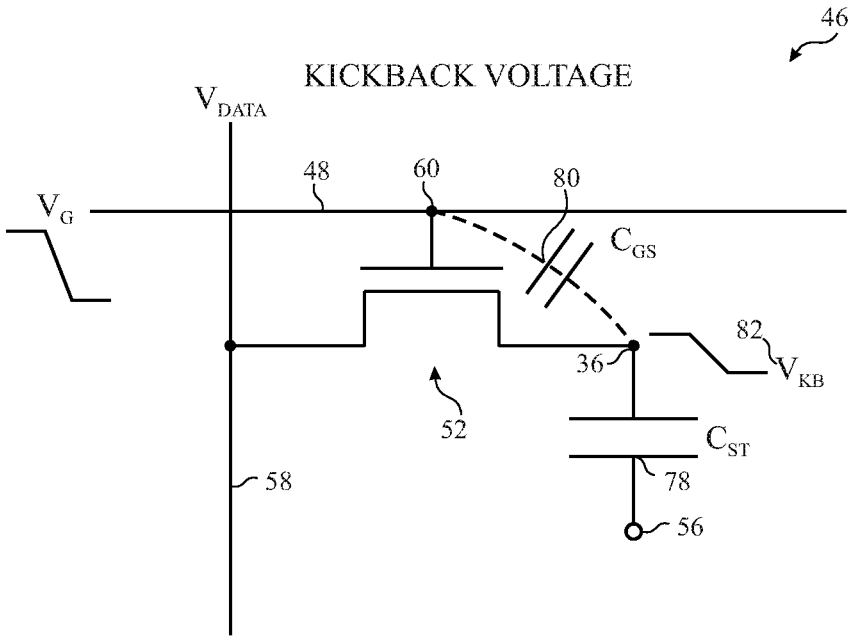
FIG. 8 is a circuit diagram of a pixel from the display components of FIG. 7, in accordance with an embodiment.

FIG. 8 shows a more detailed circuit diagram of one of the unit pixels 46 described with respect to FIG. 7. The unit pixel 46 includes the TFT 52 having a gate 60 electrically coupled to the gate line 48 of the gate driver 68. Further, the TFT 52 may include a source 58 electrically coupled to the source driver 64 via the data line 50. To display a color with a certain amount of light, the processor 12 may transmit, via the source driver 64, the image signal having a certain charge associated with the desired color on the data line 50. As mentioned above, the gate 60 of the TFT 52 may receive a gate signal that causes the TFT to close to form a conductive path from the data line 50 to the pixel electrode 54 such that the pixel electrode 54 may store the charge received via the data line 50. Due to a voltage of the pixel of the pixel electrode 54 and a voltage of the common electrode 56 as well as the physical geometry of the pixel electrode 54 with respect to the common electrode 56, an electrical field may be present between the common electrode 56 and the pixel electrode. The electric field may cause liquid crystal material in the electric field to modulate an amount of light depending on the magnitude of the electric field across the liquid crystal material. As such, the source driver 64 may be used in conjunction with the gate drivers 68 and 70 to control the light generated by the pixel 46.

To control the gate 60 of the TFT 52, the gate line 48 may change between a relatively high voltage (e.g., 10V to 20V) and a relatively low voltage (e.g., 0V to −15V). Owing to the change in the voltage and the physical geometry of the gate line 48 and the common electrode 56, there may be a capacitance 80 that causes a kickback voltage 82 ($V_{KB}$), thereby creating nonuniformities in the VCOM voltage.

Figure 9:
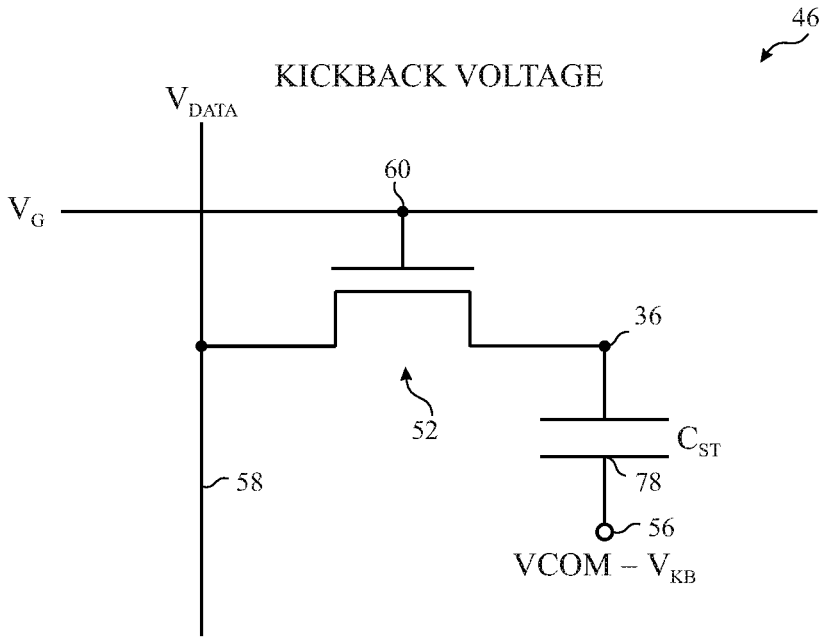
FIG. 9 is a circuit diagram of an equivalent circuit of the pixel of FIG. 8, in accordance with an embodiment.

This may be more apparent in FIG. 9, which represents a circuit diagram of an equivalent circuit of the pixel 46. As seen in FIG. 9, the pixel 46 includes the TFT 52 electrically coupled to the data line 50 as well as the gate 60 electrically coupled to the gate line 48. The VCOM voltage with respect to the pixel electrode 54 across the storage capacitance 78 may be altered due to the kickback voltage. That is, the voltage between the common electrode 56 and the pixel electrode 54 may either be reduced or increased, depending on a polarity of a voltage of the pixel electrode 54, from the kickback voltage ($V_{KB}$). This altered voltage difference ($VCOM-V_{KB}$) alters the electric field across the liquid crystal material of the pixel 46, thereby causing output of the display 18 to be different than the desired output.

In some LCD displays that use a column inversion scheme, the LCD display 18 may alternate the pixel electrode 54 voltages between a positive polarity and a negative polarity to cause the electric field to reduce or eliminate buildup of ions in the liquid crystal molecules of the LCD display. That is, the pixel electrode 54 may receive a positive charge that causes the electric field to be in a first direction in a first frame and receive a negative charge that causes the electric field to be in a second direction in a second frame where the electrical field has approximately the same magnitude in each frame (e.g., to produce the same gray level). However, due to the kickback voltage, the common electrode may have a voltage different than the expected voltage, thereby causing an offset in the magnitude of the electric field between the first frame and the second frame. For example, the first frame may have a voltage between the common electrode 56 and the pixel electrode 54 of +0.8V and the second frame may have a voltage between the common electrode 56 and the pixel electrode 54 of −0.7V, the offset being 100 mV. Because the magnitude of the electric field is different between the first frame and the second frame, the difference may cause a flicker to occur in the display 18, thereby reducing the quality in images displayed on the display 18. For the foregoing reasons, it is desirable to adjust the voltage of the image signals based on the nonuniformities in the VCOM to cause the electric field to be consistent with the desired electric field.

Figure 10:
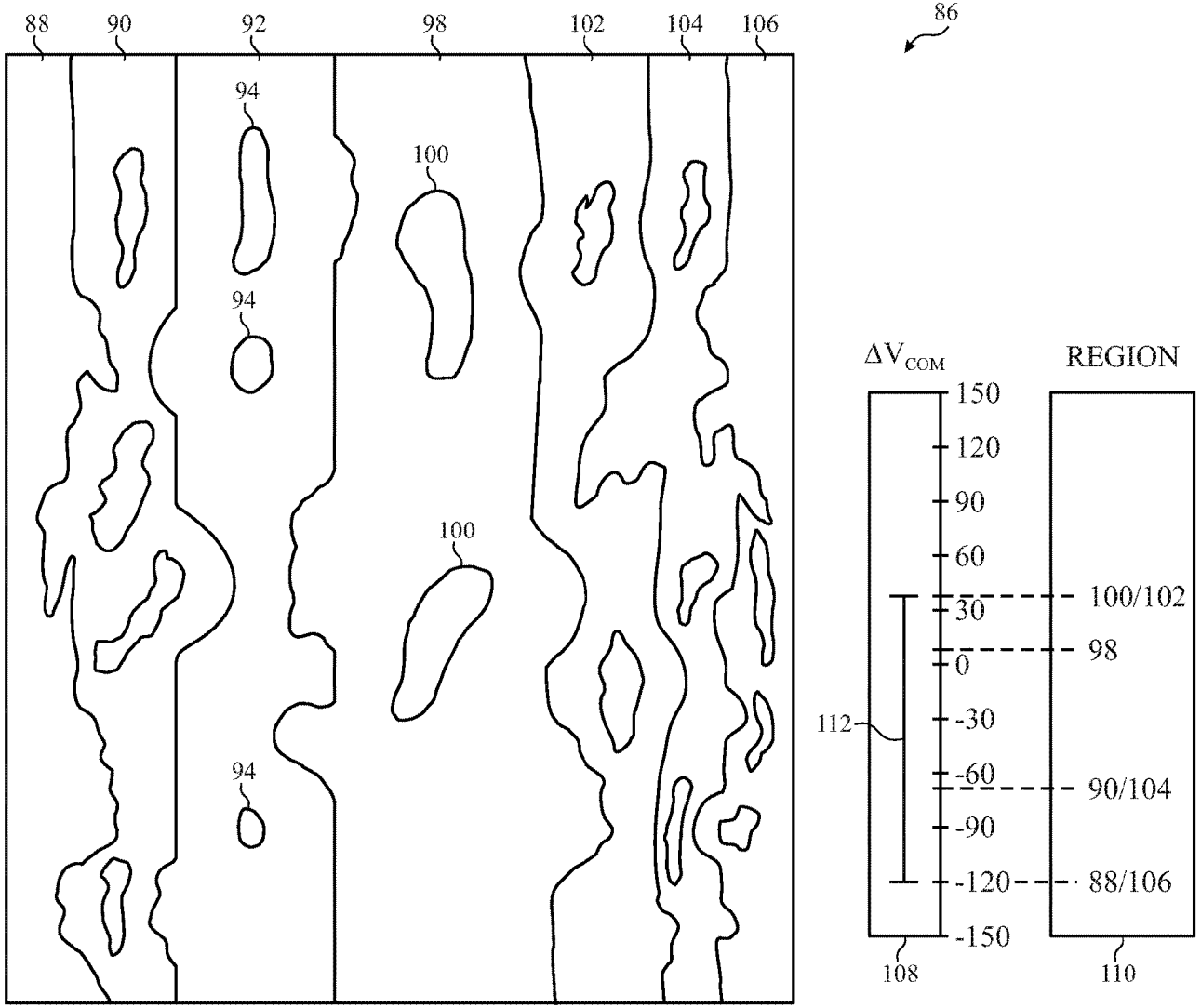
FIG. 10 is a measurement of a nonuniform VCOM on the electronic display, in accordance with an embodiment.

Different pixels 46 in the display 18 may have different kickback voltages caused by the gate line 48 due to process variation. FIG. 10 shows a VCOM nonuniformity map 86 of variations of VCOM across the display 18. The VCOM nonuniformity map 86 may be obtained by observing changes in light emission in various areas of the display 18 (e.g., during the manufacture of the display 18 or after the display 18 is in commercial use, such as when the electronic device 10 that houses the display 18 is being serviced). For example, a video camera may be used to capture video images of the display 18 over time to map where on the display 18 signs of flicker are more discernible. To obtain the measurements of the nonuniform VCOM, the video camera may record the display 18. The display 18 may display a pattern that is particularly well-suited to display flicker (e.g., a flicker-identification gray scale pattern) during the recording. Multiple image frames may be recorded. Light emitted from the image frames at various locations across the display 18 may be compared to a nominal value, and a difference between the light emitted at each location on the display 18 may correspond to the variation that would arise between some nominal VCOM voltage and the actual VCOM voltage. In this way, an estimated measurement of the actual VCOM voltage that would produce the levels of flicker or distortion may be used to produce the VCOM nonuniformity map 86.

As seen in the VCOM nonuniformity map 86 shown in FIG. 10, due to a resistance-capacitance (RC) delay, there may be a faster variation rate along edges of the display 18, where the gate drivers 68 and 70 are located, than toward the center of the display 18. The VCOM nonuniformity map 86 of FIG. 10 is broken into regions 88, 90, 92, 94, 96, 98, 100, 102, 104, and 106 that correspond to a different magnitude of difference between the desired (nominal) VCOM and the actual VCOM that is on the display 18 at the different regions. The regions shown in FIG. 10 should be understood to be provided by way of example; any suitable number of regions may be used.

In the example of FIG. 10, regions 88 and 106 may be located closer to the gate drivers 68 and 70 of FIG. 7 than the regions 92, 98, and 102 towards the center of the display 18. Additionally or alternatively, there may be VCOM differences, as represented by regions 94 and 100, due to process variation in manufacturing the display 18. A scale 108 shows the difference between the measured VCOM of various regions 110 from the VCOM nonuniformity map 86 and the nominal VCOM voltage (e.g., a spatially uniform nominal VCOM voltage). As an example, the nonuniform VCOM of the VCOM nonuniformity map 86 has regions 110 with a variance 112 in the measured VCOM of approximately 160 mV. While a particular example of the variance 112 is shown in FIG. 10, any suitable nonuniform VCOM may be present in the display 18. This nonuniform VCOM may cause the flicker that may be visible depending on the image displayed. Because the flicker may reduce the quality of the display 18, it is desirable to correct for the nonuniformity of the VCOM voltages.

Figure 11:
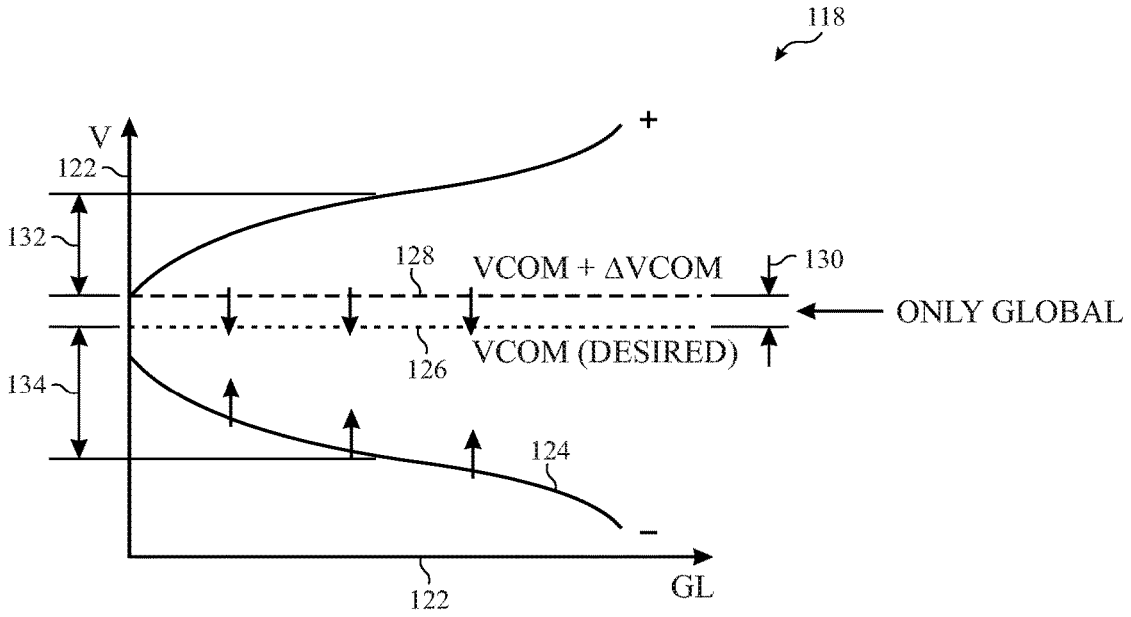
FIG. 11 is a graph of voltage with respect to gray level of a VCOM and the pixel, in accordance with an embodiment.

FIG. 11 is a graph 118 of voltage, shown on the y-axis 120, with respect to gray level, shown on the x-axis 122, of the unit pixel 46. The graph 118 shows a pixel electrode 54 voltage profile 124 of various positive voltages and negative voltages of the pixel electrode 54 to obtain certain gray levels on the unit pixel 46. The graph 118 includes a nominal VCOM voltage line 126 indicating the desired voltage to be output on the VCOM to obtain the desired image. The graph 118 includes the actual VCOM voltage line 128 that is measured using the process described with respect to FIG. 10. The kickback voltage may cause the difference 130 between the actual VCOM voltage line 128 and the nominal VCOM voltage line 126. Further, the difference 130 may cause a first voltage potential 132 while the pixel electrode 54 stores a positive voltage and a second voltage potential 134 while the pixel electrode 54 stores the negative voltage, thereby causing flicker on the display. To compensate for the difference (i.e., offset) 130, in some embodiments, the actual VCOM voltage line 128 may be controlled. That is, the actual VCOM voltage line 128 may be reduced to the desired nominal VCOM voltage line 126. However, reducing the actual VCOM voltage line 128 may increase the complexity of the display 18 due to the VCOM operating as a common electrode 56 across the display 18. Because the common electrode 56 may receive a common voltage across the display, some embodiments described below may adjust the charge stored on the pixel electrode 54 to compensate for the difference 130.

Figure 12:
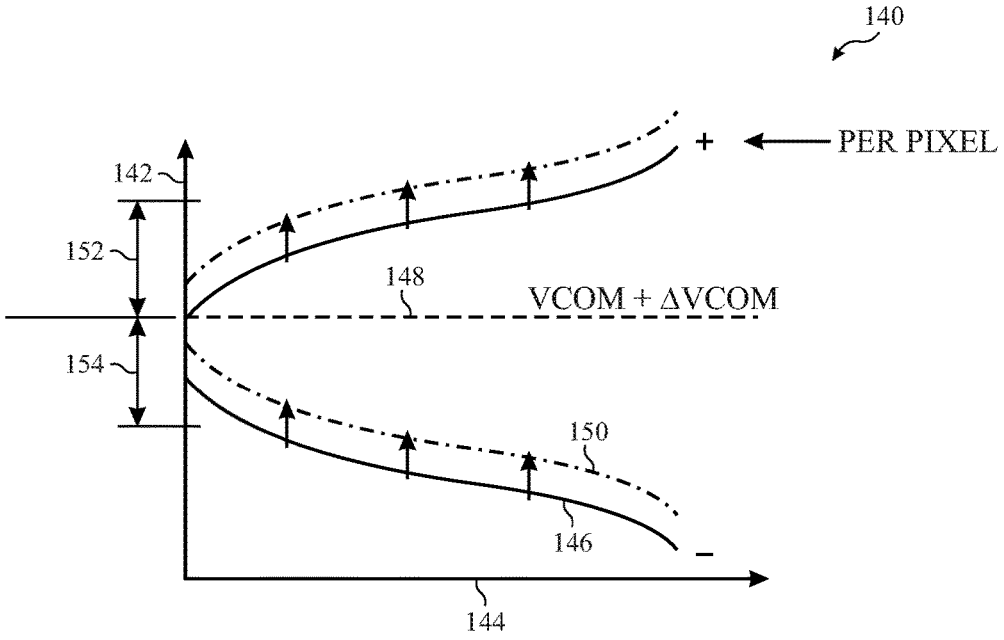
FIG. 12 is another graph of voltage with respect to gray level of a VCOM and the pixel, in accordance with an embodiment.

To address the flicker of the display 18 due to the kickback voltage without adjusting the voltage applied to the common electrode 56, the processor 12 may send, via the source driver 64, an image signal having a charge to be stored on the pixel electrode 54 that is adjusted based on the difference 130. FIG. 12 is a graph 140 of voltage, shown on the y-axis 142, and gray level, shown on the x-axis 144, of the unit pixel 46. In the illustrated embodiment, the display 18 implements a compensation scheme that provides an image signal from the source driver 64 having a charge to be stored on the pixel electrode 54 that is adjusted based on the difference 130. The graph 140 shows a pixel electrode 54 voltage profile 146 of the positive voltages and negative voltages of the pixel electrode 54 to obtain certain gray levels on the unit pixel 46. Further, the graph 140 includes the actual VCOM voltage line 148 from the measurements described with respect to FIG. 10. To adjust the magnitude of the electric field to output the desired amount of light from the pixel, the processor(s) 12, which may include any suitable pixel pipeline processing, may output an adjusted image signal that adjusts the charge to be stored by the pixel electrode 54 based on the difference 130. Further, by adjusting the image signal by an amount based on the difference 130, the pixel electrode 54 voltage profile 146 may be adjusted a corresponding amount that causes the positive voltage potential 152 and the negative voltage potential 154 to be approximately equal, thereby reducing or eliminating flicker in the display 18.

Figure 13:
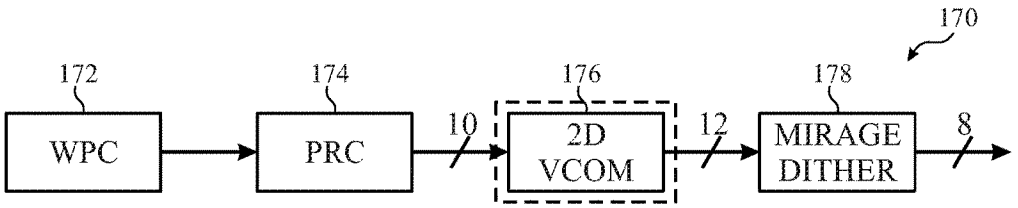
FIG. 13 is a process flow diagram of a process to manufacture the electronic display of the device of FIG. 1 to compensate for the nonuniform VCOM, in accordance with an embodiment.

FIG. 13 is a block diagram of image processing circuitry 170 (e.g., pixel processing pipeline circuitry) that prepares image data to be sent to the display 18. The image processing circuitry 170 adjusts the image data before the image data is used in the electronic display by changing the image data to correct for spatially nonuniform offset voltages in the VCOM due to kickback voltages. The image processing circuitry 170 may be disposed in a pixel pipeline of part of the display.

The image processing circuitry 170 includes white point correction (WPC) circuitry 172 that adjusts the data to be programmed into the pixel to account for changes in the white point. That is, WPC circuitry 172 adjusts the pixel data to define the correct white color of the image. The image processing circuitry 170 may include panel response correction (PRC) circuitry 174 where the response of the panel is corrected. The image processing circuitry 170 may include dimensional (e.g., 1D or 2D) VCOM correction circuitry 176. Further, a look up table may be stored (e.g., locally) in the VCOM correction circuitry 176 that maps pixels to VCOM voltage differences. In operation, the image processing circuitry 170 may send the adjusted image signal, via the source driver 64 of the display 18, to the pixel electrode 54 such that the adjusted image signal has a voltage adjustment that matches the VCOM voltage difference 130. The image processing circuitry 170 may then perform dithering, such as mirage dithering, via dithering circuitry 178 on the adjusted image signal after performing the VCOM voltage correction.

Figure 14:
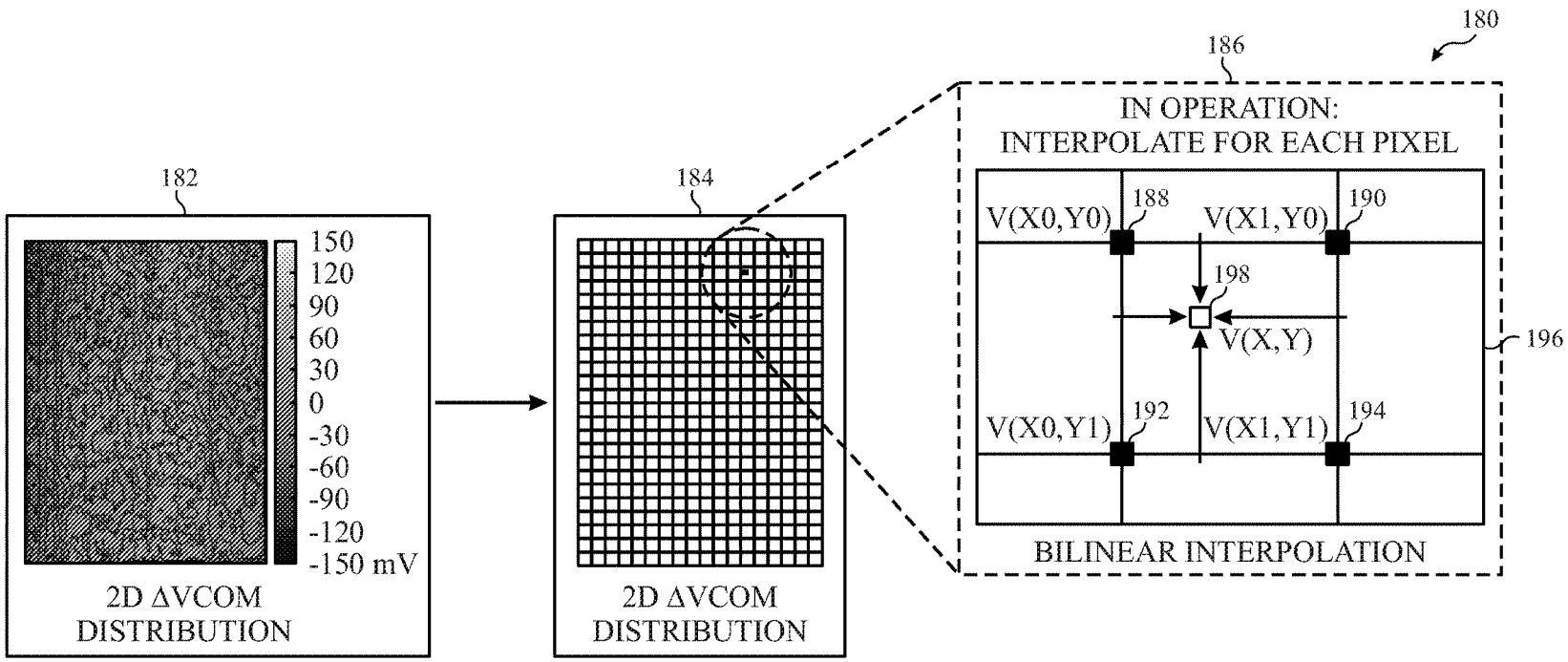
FIG. 14 is a flow diagram of a VCOM correction that may be performed in the process of FIG. 13, in accordance with an embodiment.

FIG. 14 is a flow diagram of the 2D VCOM correction process 180 that may be performed to correct for the spatially nonuniform offset voltage of the VCOM. During a manufacturing process, measurements of a difference between a desired common electrode voltage and a measured common electrode voltage at one or more locations on the display (block 182). For example, image frames may be captured and processed as described above with respect to FIG. 10. From the obtained measurements, the 2D VCOM distribution of differences (e.g., distribution of voltages) between the desired common electrode and the measured common electrode voltage may be stored in a lookup table in the VCOM correction circuitry 176 that associates locations on the display 18 with the differences (block 184). After the manufacturing process is completed, the VCOM correction circuitry 176 may perform the 2D VCOM adjustments (block 186) during operation of the display 18, as described above with respect to FIG. 13. In some embodiments, there may be a look up table that is applied to all colors. In other embodiments, a look up table may be created associated with each color.

The lookup table may include one or more locations 188, 190, 192, and 194 at crossing points of a grid 196. Each of the locations 188, 190, 192, and 194 may be associated with a respective difference between the desired common electrode voltage and the measured common electrode voltage at the respective location. During operation, the processor 12 may obtain the difference associated with the pixel 46 at the location and a desired voltage to be output to the pixel electrode 54. The processor 12 may output the image signal to cause a charge on the pixel electrode 54 that is adjusted based on the difference, thereby generating the desired electric field associated with the particular image data. Further, the processor 12 may perform any suitable interpolation, such as bilinear interpolation, (block 186) between the locations 188, 190, 192, and 194 stored in the lookup table to obtain an approximate VCOM voltage difference at location 198 between the locations 188, 190, 192, and 194 while limiting the size of the lookup table.

FIG. 15 is a schematic diagram of an example of a grid 208 of a lookup table that may be stored in the memory 14. The lookup table may include VCOM differences at locations of each of the crossing points of the grid 208. The more locations used, the finer granularity of the grid 208 and the larger the look up table. Because the variance in VCOM differences may be greater along edges (e.g., a periphery) of the panel due to being located closer in proximity to the gate drivers 68 and 70, the lookup table may include a finer granularity of locations along a first edge 210 and a second edge 212, as compared to granularity of a center 214 of the grid 208. While a 2D VCOM grid is described as an example, in other embodiments, a zero dimension or a one dimension grid may also be used.

Figure 16:
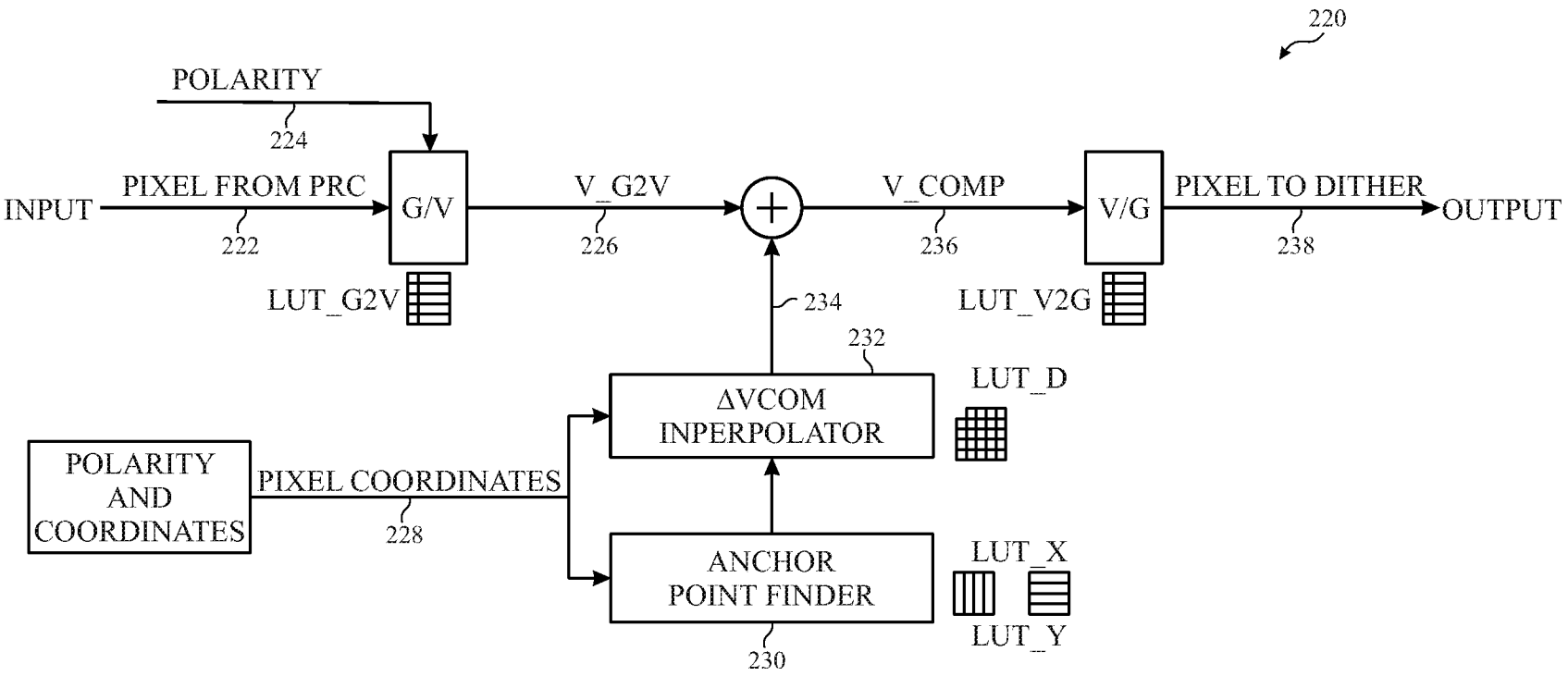
FIG. 16 is a flow diagram of a process performed by the processor of the electronic device of FIG. 1 to output a voltage to the pixel that generates the desired electric field, in accordance with an embodiment.

FIG. 16 is a schematic diagram of the VCOM correction circuitry 176 that causes the pixel 46 of the display 18 to generate the desired electric field. The process VCOM correction circuitry 176 may receive the image data 222 from the PRC circuitry 174, as well as obtain the polarity 224 of the pixel 46 (e.g., from the PRC circuitry 174 or other image processing circuitry). The VCOM correction circuitry 176 may include conversion circuitry to convert the image data 222 and the polarity 224 from a gray level domain, in which the image data 222 and the polarity are represented on a scale of gray level, into a voltage domain, in which the image data 222 and the polarity 224 are represented as a voltage 226. In the illustrated embodiment, the gray level to voltage conversion is performed via a lookup table. Further, the VCOM correction circuitry 176 may obtain the coordinates 228 and polarity of the pixel 46. The VCOM correction circuitry 176 may determine anchor points 230 based on the coordinates 228. The anchor points 230 may refer to vertical anchor points and horizontal anchor points in closest proximity to the coordinates 228 that have coordinates stored in the lookup table associated with a respective VCOM voltage difference. For example, the VCOM correction circuitry 176 may determine the locations 188, 190, 192, and 194 having the closest proximity to the coordinates 228 of the pixel 46. The VCOM correction circuitry 176 may perform interpolation 232 to provide a voltage adjustment 234 corresponding to the approximate VCOM voltage difference from the desired VCOM voltage at the pixel 46. The processor 12 may adjust the voltage 226 based on the approximate VCOM voltage difference such that the voltage 236 takes into account the nonuniformities of the VCOM due to kickback voltages. The image processing circuitry 170 may then convert the voltage 236 back into the gray level domain to perform dithering after the voltage 236 has been adjusted by the image processing circuitry 170 to correct for the spatially nonuniform offset voltage of the VCOM. The gray level domain values may then be converted to the voltage domain upon output from the dithering circuitry 178.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

What is claimed is:

1. An electronic device comprising:

an electronic display configured to display image content at least in part by controlling light emission from a plurality of display pixels implemented at corresponding pixel locations on the electronic display based at least in part on corresponding image data, wherein the image data corresponding with a display pixel of the plurality of display pixels comprises a gray level indicative of target light emission from the display pixel in the image content and the plurality of display pixels share a common electrode that has a spatially uniform nominal voltage and a spatially nonuniform offset voltage; and image processing circuitry configured to process the image data corresponding with the display pixel before supply to the electronic display at least in part by:

determining a compensation table that explicitly associates each of a subset of pixel locations on the electronic display with a compensation value to be applied to corresponding image data, wherein the pixel locations in a row of display pixels that are explicitly identified in the compensation table are nonuniformly spaced;

determining a target compensation value to be applied to the image data corresponding with the display pixel based at least in part on the compensation table and a pixel location of the display pixel; and applying the target compensation value to the image data corresponding with the display pixel to adjust the gray level before supply to the electronic display to facilitate offsetting the spatially nonuniform offset voltage of the common electrode.

2. The electronic device of claim 1, wherein the electronic display comprises a data driver electrically coupled to the display pixel via a data line, wherein the data driver is configured to supply an analog electrical signal to the display pixel via the data line to charge, discharge, or both the display pixel based at least in part on the gray level indicated in the image data received by the electronic display.

3. The electronic device of claim 1, wherein the image processing circuitry comprises conversion circuitry configured to:

convert the image data from a gray level domain to a voltage domain before application of the target compensation value, wherein the image processing circuitry is configured to apply the target compensation value in the voltage domain; and convert the image data from the voltage domain back to the gray level domain after application of the target compensation value.

4. The electronic device of claim 3, wherein:

the gray level domain is a linear domain; and the voltage domain is a non-linear domain.

5. The electronic device of claim 1, wherein, before the compensation table is used to process the image data corresponding with the image content, the compensation table is calibrated to the electronic display at least in part by:

displaying, using the electronic display, a calibration image at least in part by controlling light emission from the plurality of display pixels based on corresponding calibration image data, wherein the calibration image data corresponding with the display pixel of the plurality of display pixels comprises a calibration gray level indicative of target light emission from the display pixel in the calibration image;

determining a nominal voltage of the common electrode that is expected to result in the target light emission from the display pixel in the calibration image when the pixel electrode of the display pixel is written based on the calibration gray level indicated in the calibration image data;

capturing, using a camera, a picture of the calibration image being displayed on the electronic display;

estimating an actual voltage of the common electrode used to display the calibration image based at least in part on the picture of the calibration image being displayed on the electronic display; and calibrating the compensation table to be subsequently used by the image processing circuitry to process the image data corresponding with the image content based at least in part on a difference between the nominal voltage of the common electrode and the actual voltage of the common electrode.

6. The electronic device of claim 1, wherein the compensation table comprises a two dimensional (2D) lookup table.

7. The electronic device of claim 1, wherein the compensation table explicitly identifies more pixel locations in a periphery region of the electronic display and fewer pixel locations in a center region of the electronic display.

8. The electronic device of claim 1, wherein:

the electronic display comprises a scan driver electrically coupled to the display pixel via a scan line; and the compensation table explicitly identifies more pixel locations in a first region of the electronic device closer to the scan driver and fewer pixel locations in a second region of the electronic device farther from the scan driver.

9. The electronic device of claim 1, wherein the electronic device comprises a laptop computer, a notebook computer, a tablet computer, a desktop computer, a workstation computer, a server, a portable phone, a media player, a personal data organizer, or a handheld game platform.

10. Image processing circuitry configured to process image data before supply to an electronic display of an electronic device, wherein the image processing circuitry comprises:

correction circuitry configured to:

receive pixel data comprising a gray level indicative of target light emission from a display pixel on the electronic display, wherein the display pixel shares a common electrode that has spatially nonuniform offset voltages with another display pixel on the electronic display;

determine a target correction value to be applied to the pixel data based at least in part on a correction table and a pixel location of the display pixel on the electronic display; and process the pixel data at least in part by applying the target correction value to the pixel data such that the gray level is adjusted to facilitate offsetting the spatially nonuniform offset voltages of the common electrode of the electronic display; and memory configured to store the correction table, wherein the correction table explicitly associates each of a subset of pixel locations on the electronic display with a corresponding correction value such that the pixel locations in a line of display pixels that are explicitly identified in the correction table are nonuniformly distributed.

11. The image processing circuitry of claim 10, wherein the correction circuitry is configured to:

convert the pixel data from a gray level domain to a voltage domain;

apply the target correction value to the pixel data in the voltage domain; and convert the pixel data from the voltage domain back to the gray level domain.

12. The image processing circuitry of claim 10, wherein the correction table explicitly identifies more pixel locations in a periphery region of the electronic display and fewer pixel locations in a central region of the electronic display.

13. The image processing circuitry of claim 10, wherein the correction table explicitly identifies more pixel locations in first region of the electronic display and fewer pixel locations in a second region of the electronic display, wherein the first region is closer to a scan driver of the electronic display than the second region.

14. The image processing circuitry of claim 10, wherein, before the correction table is used to process the pixel data, the correction table is calibrated to the electronic display at least in part by:

displaying, using the electronic display, a calibration image at least in part by controlling light emission from the display pixel based on calibration image data, wherein the calibration image data corresponding with the display pixel comprises a calibration gray level indicative of target light emission from the display pixel in the calibration image;

determining a nominal voltage of the common electrode that is expected to result in the target light emission from the display pixel in the calibration image when the display pixel is written based on the calibration gray level indicated in the calibration image data;

capturing, using a camera, a picture of the calibration image being displayed on the electronic display;

estimating an actual voltage of the common electrode used to display the calibration image based at least in part on the picture of the calibration image being displayed on the electronic display; and calibrating the correction table to be subsequently used by the image processing circuitry to process the pixel data based at least in part on a difference between the nominal voltage of the common electrode and the actual voltage of the common electrode.

15. A method for calibrating image processing circuitry to be used to process image data before supply to an electronic display of an electronic device comprising:

displaying, using the electronic display, an image frame at least in part by controlling light emission from display pixels based at least in part on corresponding image data, wherein a plurality of the display pixels share a common electrode and the image data corresponding with a display pixel comprises a gray level indicative of target light emission of the display pixel;

determining a nominal voltage of the common electrode that is expected to result in the target light emission from the display pixel when a pixel electrode of the display pixel is written based on the gray level indicated in the image data;

capturing, using a camera, a picture of the image frame being displayed on the electronic display;

estimating an actual voltage of the common electrode used to display the image frame based at least in part on the picture of the image frame being displayed on the electronic display; and calibrating a compensation table to be used by the image processing circuitry to process subsequent image data based at least in part on a difference between the nominal voltage of the common electrode and the actual voltage of the common electrode, wherein the compensation table explicitly associates each of a subset of pixel locations that are nonuniformly spaced in a line of display pixels with one or more compensation values to be applied to corresponding image data.

16. The method of claim 15, wherein calibrating the compensation table comprises calibrating the compensation table to explicitly identify more pixel locations in a periphery region of the electronic display and fewer pixel locations in a central region of the electronic display.

17. The method of claim 15, wherein the compensation table comprises a two dimensional (2D) lookup table.

18. The method of claim 15, wherein calibrating the compensation table comprises calibrating the compensation table to explicitly identify more pixel locations in a first region of the electronic display and fewer pixel location in a second region of the electronic display, wherein the first region is closer to a scan driver of the electronic display than the second region.

19. The method of claim 15, wherein calibrating the compensation table comprises:

determining a compensation value to be applied to the subsequent image data corresponding with a pixel location of the display pixel based at least in part on the difference between the nominal voltage of the common electrode and the actual voltage of the common electrode; and explicitly associating the compensation value with the pixel location of the display pixel.

20. The method of claim 15, wherein:

the subsequent image data comprises red image data, blue image data, and green image data; and the one or more compensation values associated with an explicitly identified pixel location in the compensation table comprise a red component compensation value to be applied to the red image data, a blue component compensation value to be applied to the blue image data, and a green component compensation value to be applied to the green image data.

* * * * *